US005871899A

United States Patent [19]

Dickinson et al.

[11] Patent Number: 5,871,899

[45] Date of Patent: Feb. 16, 1999

[54] POLY (ALKYLENE OXIDE)S IN PHOTOGRAPHIC ELEMENTS

[75] Inventors: David A. Dickinson, Brockport; George J. Burgmaier, Pittsford; Thomas R. Welter, Webster, all of N.Y.

[73] Assignee: Eastman Kodak Company, Rochester, N.Y.

[21] Appl. No.: 848,208

[22] Filed: Apr. 30, 1997

[51] Int. Cl.[6] ..... G03C 1/295

[52] U.S. Cl. ..... 430/637; 430/514; 430/515; 430/516; 430/533; 430/535; 430/629; 430/635; 430/636

[58] Field of Search ..... 430/514, 515, 430/516, 533, 534, 535, 629, 635, 636, 637

[56] References Cited

U.S. PATENT DOCUMENTS 3,947,273 3/1976 Pollet et al. ..... 430/266

4,916,054 4/1990 Yoneyama et al. ..... 430/636

OTHER PUBLICATIONS

Y. Inaba and A. Kumai: Photographic Science and Engineering, vol. 17, No. 6, Nov./Dec. 1973.

*Primary Examiner*—Hoa Van Le
*Attorney, Agent, or Firm*—Sarah Meeks Roberts

[57] ABSTRACT

A silver halide color photographic element comprising a support, a silver halide emulsion and poly(alkylene oxide)s wherein greater than 50 percent of the poly(alkylene oxide)s have acidic functional end groups with an aqueous pKa≦10, or end groups which will react to form acidic functional end groups with an aqueous pKa≦10 during development, on both termini; and wherein the poly(alkylene oxide)s have a molecular weight ranging substantially between 1700 and 6000 AMU.

14 Claims, No Drawings

POLY (ALKYLENE OXIDE)S IN PHOTOGRAPHIC ELEMENTS

FIELD OF THE INVENTION

This invention relates to the use of development accelerators in silver halide photographic elements. More specifically it relates to the use of poly(alkylene oxide)s as the accelerators.

BACKGROUND OF THE INVENTION

It is often desirable to obtain more rapid or accelerated photographic development during the processing of a silver halide photographic material. More rapid or accelerated photographic development is observed when the same exposure and process time provides increased photographic speed or higher Dmax. It is important that the increased photographic development should not be accompanied by an undesirable increase in the amount of fog.

In order to achieve more rapid photographic development, two approaches are possible. The first approach involves a change in the process such as an increase in the temperature of the process or a change in the composition of the developer. This approach is not often practical, especially when a photographic element has more than one light sensitive layer, and each layer responds differently to process changes. The second approach is to incorporate an additive which increases the rate of photographic development into a light-sensitive layer or an adjacent non-light-sensitive layer.

A number of additives, sometimes called development accelerators, have been described which, when added to a photographic element, will increase the rate of photographic development. Some of these additives are sulfur containing materials where the sulfur is incorporated as a thioether group in a polymer as described in U.S. Pat. Nos. 3,046,132, 3,813,247, 3,046,134, 3,046,129, 3,057,724 and 3,165, 552; poly(alkylene oxide)s as described in Y. Inaba and A. Kumai: Photo. Sci. Eng., 17, 499 (1973; pyrazolidone/cyclodextran inclusion complexes as described in GB 2,261, 740; and substituted diaminedithio-containing materials as described in U.S. Pat. No. 5,192,655.

Certain poly(ethylene glycol)s have been described as development accelerators, particularly in black and white photographic systems in U.S. Pat. No. 3,947,273; similar polymeric compounds have also been described as aids to coating in U.S. Pat. No. 4,916,054. However, none of these patents describe poly(alkylene oxide)s which consistently show the high activity and uniformity of those of the current invention.

SUMMARY OF THE INVENTION

This invention provides a silver halide color photographic element comprising a support, a silver halide emulsion and poly(alkylene oxide)s wherein greater than 50 percent of the poly(alkylene oxide)s have acidic functional end groups with an aqueous pKa≦10, or end groups which will react to form acidic functional end groups with an aqueous pKa≦10 during development, on both termini; and wherein the poly(alkylene oxide)s have a molecular weight ranging substantially between 1700 and 6000 AMU. In one embodiment the poly(alkylene oxide)s are represented by Formula I $$A-(L_i-X_i)_n-L-A'$$

wherein

A and A' are independently acidic functional groups;

L and $L_i$ are independently divalent organic linking groups;

$X_i$ is independently a non-metallic heteroatom; with the proviso that at least one $X_i$ is an oxygen; and n is one to 300.

The poly(alkylene oxide)s of this invention can provide a significant increase in development yield and speed, and a change in Dmax in a photographic element. Further, the poly(alkylene oxide)s of this invention provide more uniform development acceleration.

DETAILED DESCRIPTION OF THE INVENTION

While poly(alkylene oxide)s have been described as development accelerators, the inventors herein have discovered the photographic activity of these materials can be dramatically and unexpectedly increased by forming derivatives of these materials such that the end groups are converted to acidic functional groups or groups which can react to form acidic functional groups under photographic development conditions. Examples of groups which may react to form acidic functional groups are esters, amides and isocyanates all of which may hydrolyze during the development step. Other groups may react via different mechanisms. The development step may be either with a color developer or, in the case of a color reversal process, it may take place with a black and white developer.

The poly(alkylene oxide)s known in the art are often prepared by methods which result in polymers having end groups which are all alcohols. In this invention, however, greater than 50 percent of the poly(alkylene oxide)s utilized in the photographic element have acidic functional end groups with an aqueous pKa≦10, or end groups which will react to form acidic functional end groups with an aqueous pKa≦10 during development, on both termini. Preferably greater than 95 percent of the poly(alkylene oxide)s have such groups on both termini, more preferably greater than 98 percent have such groups on both termini and most preferably substantially all of the poly(alkylene oxide)s have such groups on both termini. Acidic functional groups are preferred over groups which can react to form acidic functional groups. Preferably the poly(alkylene oxide)s have a molecular weight ranging between 1700 and 6000 AMU, and most preferably ranging between 3000 and 4500 AMU.

Polymers ending with carboxylic acid groups are particularly potent development accelerators. Polymers ending with other acidic functional groups are also possible. Such end groups could be (but are not restricted to) sulfonate groups or phosphoric acids groups. The poly(alkylene oxide)s provide a non-imagewise distribution of a photographically active moiety.

In one embodiment of this invention the silver halide color photographic element includes a support, a silver halide emulsion and poly(alkylene oxide)s wherein greater than 50 percent, more preferably greater than 95 percent, of the poly(alkylene oxide)s are represented by Formula I.

$$A-(L_i-X_i)_n-L-A'$$

A and A' are independently acidic functional groups or salts thereof with an aqueous pKa≦10. Useful examples of A and A' include carboxylic acids, carboxylate salts, sulfonic acids, sulfinic acids, cyanamides, sulfonamides, hydroxamic acids, thiols, thiolates, and the like. Most suitable are carboxylic acids, carboxylate salts, and sulfonic acids.

L and $L_i$ are independently divalent organic linking groups; preferably of about 1–35 non-hydrogen atoms, and more preferably of about 1–20 non-hydrogen atoms. The non-hydrogen atoms are preferably carbon atoms, but may also include other non-hydrogen atoms, for example nitrogen, boron or phosphorous. The linking group may be substituted or unsubstituted. Preferred linking groups include alkylene, alkenyl, arylene, aralkylene or heteroarylene groups. In one suitable embodiment L and $L_i$ are substituted or unsubstituted ethylene groups. Examples of suitable linking groups include

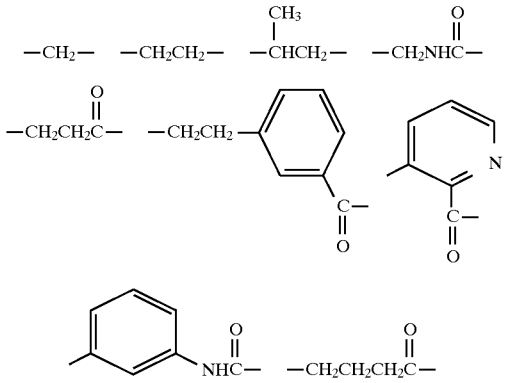

and the like.

$X_i$ is independently a non-metallic heteroatom either substituted or unsubstituted; with the proviso that at least one $X_i$ is an oxygen. Useful examples include —O—, —SO—, —$SO_2$—, and —$NR_1$— wherein $R_1$ is an organic substituent of about 1–20 non-hydrogen atoms. Preferably $X_i$ is oxygen. The non-hydrogen atoms are preferably O, N, C or S. $R_1$ may be, for example, a substituted or unsubstituted alkyl, alkenyl, aryl, aralkyl or heteroaryl, acyl, sulfonyl, or ureido group.

The ($L_i$—$X_i$) portion in structure I is normally composed of a substantially linear chain of oxygen and carbon units (such as alkylene, alkenyl, arylene, aralkylene or heteroarylene groups), such that each oxygen atom is separated from one another by at least one carbon unit.

Examples of ($L_i$—$X_i$) which can be used in the present invention include the materials below.

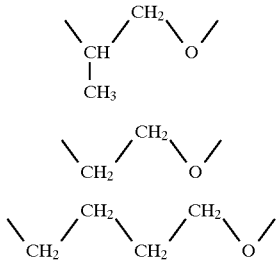

The (Li—Xi) groups may be combined to form repetitive combinations of the same (Li—Xi) groups or may be combined to form linear combinations of different (Li—Xi) groups. As such, (Li—Xi) may be combined to form block copolymers. Useful examples include block copolymers of ethylene oxide and propylene oxide also known as PLURONIC and R PLURONIC block copolymers shown below.

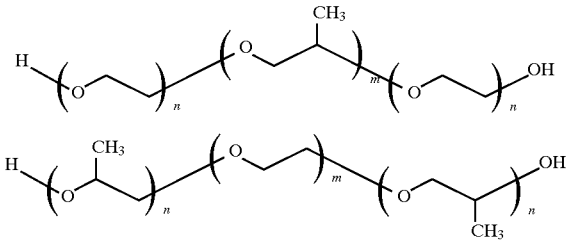

Other polymers include random copolymers of ethylene oxide and propylene, and the like. As noted above the poly(alkylene oxide)s have a molecular weight ranging between 1700 and 6000 AMU and more preferably ranging between 3000 and 4500 AMU.

Typical embodiments are shown in Table I

TABLE I

Typical Embodiments

| Number | Structure |
|---|---|
| I-1 | $HO_2CCH_2CH_2CONHCH(CH_3)CH_2(OCH_2(CH_3)CH)_{67}NHCOCH_2CH_2CO_2H$ |
| I-2 | 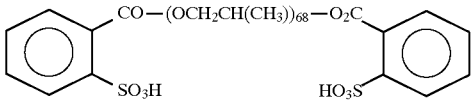 |
| I-3 | 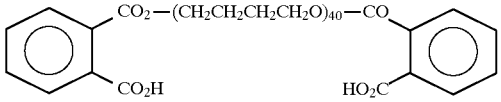 |

TABLE I-continued

Typical Embodiments

| Number | Structure |
|---|---|
| I-4 | 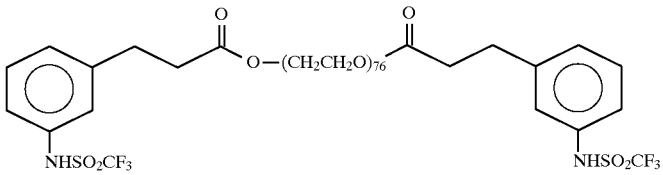 |
| I-5 | $HO_2CCH_2CH_2CH_2CO_2-(CH_2CH_2O)_{112}-CH_2CO_2H$ |
| I-6 | 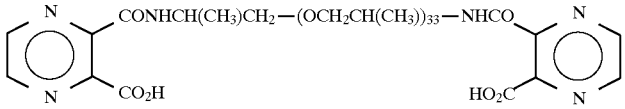 |
| I-7 | 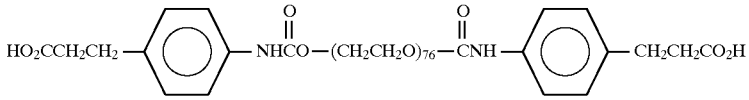 |
| I-8 | $HO_2C(CH_2)_3CONHCH(CH_3)CH_2(OCH(CH_3))_f-(OCH_2CH_2)_g-(OCH_2CH(CH_3))_h-NHCO(CH_2)_3CO_2H$ <br> f, g, h such that MW ≧2000 |
| I-9 | 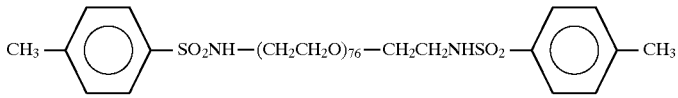 |
| I-10 | 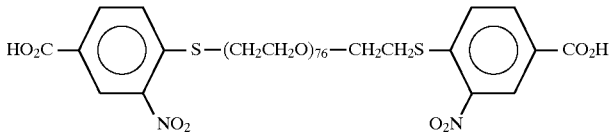 |

It is understood throughout this specification and claims that any reference to a substituent by the identification of a group containing a substitutable hydrogen (e.g., alkyl, amine, aryl, alkoxy, heterocyclic, etc.), unless otherwise specifically described as unsubstituted or as substituted with only certain substituents, shall encompass not only the substituent's unsubstituted form but also its form substituted with any substituents which do not negate the advantages of this invention. Examples of suitable substituents include halogen, such as chlorine, bromine or fluorine; alkyl or aryl groups, including straight, branched or cyclic alkyl groups, such as those containing 1 to 30 carbon atoms, for example methyl, trifluoromethyl, ethyl, t-butyl, phenyl, tetradecylphenyl, 4-t-butylphenyl, 2,4,6-trimethylphenyl and naphthyl; alkoxy groups, such as an alkoxy group containing 1 to 30 carbon atoms, for example methoxy, ethoxy, 2-ethylhexyloxy and tetradecyloxy; aryloxy groups, such as phenoxy, α- or β-naphthyloxy, and 4-tolyloxy; acylamino groups, such as acetamido, benzamido, butyramido, tetradecanamido, α-(2,4-di-t-amylphenoxy)-acetamido, α-(2,4-di-t-amyl-phenoxy)butyramido, α-(3-pentadecylphenoxy)hexanamido, α-(4-hydroxy-3-t-butylphenoxy)tetradecanamido, 2-oxo-pyrrolidin-1-yl, 2-oxo-5-tetradecylpyrrolin-1-yl, N-methyltetradecanamido, and t-butylcarbonamido; sulfonamido groups, such as methanesulfonamido, benzenesulfonamido, p-toluenesulfonamido, p-dodecylbenzenesulfonamido, N-methyltetradecylsulfonamido, and hexadecanesulfonamido; sulfamoyl groups, such as N-methylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]-sulfamoyl, N-methyl-N-tetradecylsulfamoyl, and N-dodecylsulfamoyl; sufamido groups, such as N-methylsulfamido and N-octadecylsulfamido; carbamoyl groups, such as N-methylcarbamoyl, N-octadecylcarbamoyl, N-[4-(2,4-di-t-pentyl-phenoxy)butyl]carbamoyl, N-methyl-N-tetradecylcarbamoyl, and N,N-dioctylcarbamoyl; diacylamino groups, such as N-succinimido, N-phthalimido, 2,5-dioxo-1-oxazolidinyl, 3-dodecyl-2,5-dioxo-1-imidazolyl, and N-acetyl-N-dodecylamino; aryloxycarbonyl groups, such as phenoxycarbonyl and p-dodecyloxphenoxy carbonyl; alkoxycarbonyl groups, such as alkoxycarbonyl groups containing 2 to 30 carbon atoms, for example methoxycarbonyl, tetradecyloxycarbonyl, ethoxycarbonyl, benzyloxcarbonyl, and dodecyloxycarbonyl; alkoxysulfonyl groups, such as alkoxysulfonyl groups containing 1 to 30 carbon atoms, for example methoxysulfonyl, octyloxysulfonyl, tetradecyloxysulfonyl, and 2-ethylhexyloxysulfonyl; aryloxysulfonyl groups, such as phenoxysulfonyl, 2,4-di-t-amylphenoxysulfonyl; alkanesulfonyl groups, such as alkanesulfonyl groups containing 1 to 30 carbon atoms, for example methanesulfonyl, octanesulfonyl, 2-ethylhexanesulfonyl, and hexadecanesulfonyl; arenesulfonyl groups, such as benzenesulfonyl, 4-nonylbenzenesulfonyl, and p-toluenesulfonyl; alkylthio groups, such as alkylthio groups containing 1 to 22 carbon atoms; for example ethylthio, octylthio, benzylthio, tetradecylthio, and 2-(2,4-di-t-amylphenoxy)ethylthio; arylthio groups, such as phenylthio and p-tolylthio; alkoxycarbonylamino, such as ethoxycarbonylamino, benzyloxycarbonylamino, and hexadecyloxycarbonylamino; alkylureido groups, such as N-methylureido, N,N-dimethylureido, N-methyl-N-dodecylureido, N-hexadecylureido, N,N-dioctadecylureido, and N,N-dioctyl-N'-ethyl-ureido; acyloxy groups, such as acetyloxy, benzoyloxy, octadecanoyloxy, p-dodecanamidobenzoyloxy, and cyclohexanecarbonyloxy; nitro groups; cyano groups; carboxy groups or other acid groups and heterocyclic groups including 3- to 15-membered rings with at least one atom selected from nitrogen, oxygen, sulfur, selenium and tellurium such as pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings; where preferably the foregoing organic substituents contain not more than 10 and more preferably not more than 5 carbon atoms. Furthermore, any reference to an alkyl group includes cyclic groups.

The color silver halide photographic element of the invention can have any of the image forming or non-imaging forming layers known in the art. The photographic element is a multilayer, multicolor element and includes both negative and reversal elements. A multicolor element contains dye image-forming units sensitive to each of the three primary regions of the visible light spectrum. Each unit can be comprised of a single emulsion layer, or of multiple emulsion layers spectrally sensitive to the same or substantially the same region of the spectrum. The layers of the element, can be arranged in various orders as known in the art.

In this invention the multicolor photographic element comprises a support having situated thereon, preferably in order from the support, a red light-sensitive, cyan dye-forming unit comprising a photosensitive silver halide emulsion layer and an image dye-forming coupler; a green light-sensitive, magenta dye-forming unit comprising a photosensitive silver halide emulsion layer and an image dye-forming coupler; and a blue light-sensitive, yellow dye-forming unit comprising a photosensitive silver halide emulsion layer and an image dye-forming coupler.

Photographic emulsions are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. Preferably, the emulsion is sensitized both with gold and a chalcogenide, most preferably gold and sulfur. Examples of sulfur sensitizers include sodium thiosulfate, alkyl or aryl thiourea compounds, or thiourea compounds with nucleophilic substituents as described in U.S. Pat. No. 4,810,626. Examples of gold sensitizers include potassium tetrachloroaurate, potassium dithiocyanato gold (I), trisodium dithiosulfato gold(I), and the gold (I) compounds described in U.S. Pat. Nos. 5,049,484; 5,049,485; 5,252,455; 5,220,030; and 5,391,727. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, bead coating, curtain coating and extrusion coating.

The compounds of this invention may be added to the silver halide emulsion at any time during the preparation of the emulsion, i.e., during precipitation, during or before chemical sensitization or during final melting and co-mixing of the emulsion and additives for coating. More preferably, these compounds are added during final melting and co-mixing of the emulsion and additives for coating.

Useful levels of the poly(alkyene oxide)s range from 0.02 to 20.0 millimoles per silver mole. The preferred range is from 0.10 to 2.0 millimoles per silver mole with a more preferred range being from 0.2 to 1.0 millimoles per silver mole.

The compounds may be added to the photographic emulsion using any technique suitable for this purpose. Preferably they are added as a direct dispersion prepared by the standard methods known to those skilled in the art or from methanol or water solutions depending on solubility. Combinations of more than one poly(alkyene oxide) may be utilized.

The element may contain layers in addition to those described above. Such layers include filter layers, in particularly yellow and magenta filter dye layers, interlayers, overcoat layers, subbing layers, and the like. The photographic elements may also contain a transparent magnetic recording layer such as a layer containing magnetic particles on the underside of a transparent support, as described in *Research Disclosure*, November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994(Patent Office of Japan and Library of Congress of Japan) and may be utilized in a small format system, such as described in *Research Disclosure*, June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

The silver halide emulsion employed in the dye-forming units of the invention can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains.

The silver halide emulsion can be either monodisperse or polydisperse as precipitated. The grain size distribution of the emulsion can be controlled by silver halide grain separation techniques or by blending silver halide emulsions of differing grain sizes.

The grains may be comprised of any halide combination, including silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. Preferred are iodobromide emulsions with an iodide content of 2 to 12%.

The grains can be contained in any conventional dispersing medium capable of being used in photographic emulsions. Specifically, it is contemplated that the dispersing medium be an aqueous gelatino-peptizer dispersing medium, of which gelatin—e.g., alkali treated gelatin (cattle bone and hide gelatin)—or acid treated gelatin (pigskin gelatin) and gelatin derivatives—e.g., acetylated gelatin, phthalated gelatin—are specifically contemplated. When used, gelatin is preferably at levels of 0.01 to 100 grams per total silver mole. Also contemplated are dispersing mediums comprised of synthetic colloids.

Silver halide color reversal films are typically associated with an indication for processing by a color reversal process. Reference to a film being associated with an indication for processing by a color reversal process, most typically means the film, its container, or packaging (which includes printed inserts provided with the film), will have an indication on it that the film should be processed by a color reversal process. The indication may, for example, be simply a printed statement stating that the film is a "reversal film" or that it should be processed by a color reversal process, or simply a reference to a known color reversal process such as "Process E-6". A "color reversal" process in this context is one employing treatment with a non-chromogenic developer (that is, a developer which will not imagewise produce color by reaction with other compounds in the film; sometimes referenced as a "black and white developer"). This is followed by fogging unexposed silver halide, usually either chemically or by exposure to light. Then the element is treated with a color developer (that is, a developer which will produce color in an imagewise manner upon reaction with other compounds in the film).

In a typical construction, a reversal film does not have any masking couplers. Furthermore, reversal films have a gamma generally between 1.5 and 2.0, a gamma which is much higher than the gamma for typical negative materials.

In the following Table, reference will be made to (1) *Research Disclosure*, December 1978, Item 17643, (2) *Research Disclosure*, December 1989, Item 308119, (3) *Research Disclosure*, September 1994, Item 36544, and (4) *Research Disclosure*, September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure*, February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3 & 4 | I, II, III, IX A & B | hardeners, coating aids, addenda, etc. |
| 1 | III, IV | Chemical sensitization and |
| 2 | III, IV | spectral sensitization/ |
| 3 & 4 | IV, V | desensitization |
| 1 | V | UV dyes, optical |
| 2 | V | brighteners, luminescent |
| 3 & 4 | VI | dyes |
| 1 | VI | Antifoggants and stabilizers |
| 2 | VI | |
| 3 & 4 | VII | |
| 1 | VIII | Absorbing and scattering |
| 2 | VIII, XIII, XVI | materials; Antistatic layers; matting agents |
| 3 & 4 | VIII, IX C & D | |
| 1 | VII | Image-couplers and image- |
| 2 | VII | modifying couplers; Wash- |
| 3 & 4 | X | out couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

Supports for photographic elements of the present invention include polymeric films such as cellulose esters (for example, cellulose triacetate and diacetate) and polyesters of dibasic aromatic carboxylic acids with divalent alcohols (for example, poly(ethylene-terephthalate), poly(ethylene-napthalates)), paper and polymer coated paper. Such supports are described in further detail in *Research Disclosure* 3, Section XV.

The photographic elements may also contain additional materials that accelerate or otherwise modify the processing steps of bleaching or fixing to improve the quality of the image. Bleach accelerators described in European Patent Applications No. 193,389 and 301,477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); electron transfer agents (U.S. Pat. Nos. 4,859,578 and 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol and/or yellow and/or magenta filter dyes, either as oil-in-water dispersions, latex dispersions or as solid particle dispersions. Additionally, they may be used with "smearing" couplers (e.g. as described in U.S. Pat. No. 4,366,237; European Patent Application 96,570; U.S. Pat. No. 4,420,556; and 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). DIR compounds are disclosed, for example, in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. DIRs that have particular application in color reversal elements are disclosed in U.S. Pat. Nos. 5,399,465; 5,380,633; 5,399,466; and 5,310,642.

It is also contemplated that the concepts of the present invention may be employed to obtain reflection color prints. The emulsions and materials to form elements of the present invention, may be coated on pH adjusted support as described in U.S. Pat. No. 4,917,994; with epoxy solvents (European Patent Application 0 164 961); with additional stabilizers (as described, for example, in U.S. Pat. Nos. 4,346,165; 4,540,653 and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077, 822; 90-078,229; 90-078,230; 90-079,336; 90-079,338; 90-079,690; 90-07-3,691; 90-080,487; 90-080,489; 90-080, 490; 90-080,491; 90-080,492; 90-080,494; 90-085,928; 90-086,669; 90-086,670; 90-087,361; 90-087,362; 90-087, 363; 90-087,364; 90-088,096; 90-088,097; 90-093,662; 90-093,663; 90-093,664; 90-093,665; 90-093,666; 90-093, 668; 90-094,055; 90-094,056; 90-101,937; 90-103,409; 90-151,577.

The silver halide grains to be used in the invention may be prepared according to methods known in the art, such as those described in *Research Disclosure* 3 and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure* 3 and the references cited therein.

The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in *Research Disclosure,* June 1975, item 13452 and U.S. Pat. No. 3,772,031.

The silver halide may be sensitized by sensitizing dyes by any method known in the art, such as described in *Research Disclosure* 3. Examples of dyes include dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, stryryls, merostyryls, and streptocyanines. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating.

Photographic elements of the present invention can be imagewise exposed using any of the known techniques, including those described in *Research Disclosure* 3. This typically involves exposure to light in the visible region of the spectrum, and typically such exposure is of a live image through a lens. However, the photographic elements of the present invention may be exposed in a film writer as described above. Exposure in a film writer is an exposure to a stored image (such as a computer stored image) by means of light emitting devices (such as light controlled by light valves, CRT and the like).

Standard processing for negative or reversal elements may be utilized, including standard Kodak C-41 and Kodak E-6 processing. The color reversal process requires first treating the element with a black and white developer, followed by fogging non-exposed grains using chemical or light fogging, followed by treatment with a color developer.

Preferred non-chromogenic developers (that is, black and white developers) are hydroquinones (such as hydroquinone sulphonate).

Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(b-(methanesulfonamido) ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water soluble salts and complexes of iron (III) (e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like. Further details of bleach and fixing baths can be found in *Research Disclosure* 3.

The photographic elements can be incorporated into exposure structures intended for repeated use or exposure structures intended for limited use, variously referred to as single use cameras, lens with film, or photosensitive material package units. However, the color reversal elements of the present invention can also be used by exposing in an electronic film writer (such film writers typically expose the film by laser, laser diode, or some other controlled light source).

The practice of the invention is described in detail below with reference to specific illustrative examples, but the invention is not to be construed as being limited thereto.

EXAMPLES

Preparative Examples

Compound 13

To 200 mL of THF which had been dried over 4 A molecular sieves was added 68.00 g PEG 3400, 4.79 g glutaric anhydride and 6.2 mL triethyl amine. After heating the solution at reflux for 24 hr, the solvent was removed under reduced pressure, leaving a white residue. The solid was dissolved in 250 mL dichloromethane which was then extracted with 150 mL water containing 4.5 mL concentrated hydrochloric acid. The dichloromethane solution was dried over anhydrous magnesium sulfate and then concentrated under vacuum to give a white solid. The materials was triturated briefly in cold diethyl ether, collecting 67.18 g of a white solid. Analysis of this material by titration with base indicated an acid end group population of 0.514 meq/gram.

Compound 27–28

A mixture of 3.40 g of the diamine 17 of Table II and 0.3 g phthalic anhydride in 25 mL of dichloromethane was stirred at ambient temperature for 3 h. The mixture was concentrated in vacuo for about one-quarter volume; this solution was then added dropwise to 400 mL of vigorously stirred ethyl ether. The resulting solid was collected via filtration and air dried to afford Compound 27 (3.42 g, 92%) as a colorless solid. GPC analysis indicated one major fraction with small impurities of higher and lower molecular weight.

Employing this method substituting 3-nitrophthalic anhydride, Compound 28 was prepared in 92% yield. GPC analysis again showed one major fraction with small impurities of higher and lower molecular weights.

Comparative Compounds 1–8, 17–19 and 25

These poly(alkylene oxide)s used were purchased from Aldrich Chemical Co., Milwaukee, Wis. or Shearwater Polymer Inc., Huntsville, Ala.

TABLE II

Structures of Example Compounds
$X-(CH_2CH_2O)_n-CH_2CH_2-X$

| Cmpd No. | ~n | X |
|---|---|---|
| 1[c] | 12 | $-OH$ |
| 2[c] | 22 | $-OH$ |
| 3[c] | 33 | $-OH$ |
| 4[c] | 44 | $-OH$ |
| 5[c] | 76 | $-OH$ |
| 6[c] | 103 | $-OH$ |
| 7[c] | 135 | $-OH$ |
| 8[c] | 181 | $-OH$ |
| 9[c] | 12 | $-OC(=O)CH_2CH_2CH_2C(=O)OH$ |
| 10[c] | 22 | $-OC(=O)CH_2CH_2CH_2C(=O)OH$ |
| 11[i] | 33 | $-OC(=O)CH_2CH_2CH_2C(=O)OH$ |
| 12[i] | 44 | $-OC(=O)CH_2CH_2CH_2C(=O)OH$ |
| 13[i] | 76 | $-OC(=O)CH_2CH_2CH_2C(=O)OH$ |
| 14[i] | 103 | $-OC(=O)CH_2CH_2CH_2C(=O)OH$ |
| 15[i] | 135 | $-OC(=O)CH_2CH_2CH_2C(=O)OH$ |
| 16[i] | 181 | $-OC(=O)CH_2CH_2CH_2C(=O)OH$ |
| 17[c] | 76 | $-NH_2$ |
| 18[c] | 76 | $-OCH_2C(=O)NHNH_2$ |
| 19[c] | 76 | $-SH$ |
| 20[i] | 76 | $-OC(=O)CH_2CH_2C(=O)OH$ |
| 21[i] | 76 | $-OCH_2CO_2H$ |
| 22[i] | 76 | $-OCH_2CH_2CO_2H$ |
| 23[i] | 76 | $-SCH_2CH_2CO_2H$ |
| 24[i] | 76 | $-OC(=O)NHCH_2CO_2H$ |
| 25[c] | 76 | 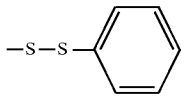 |
| 26[i] | 76 | 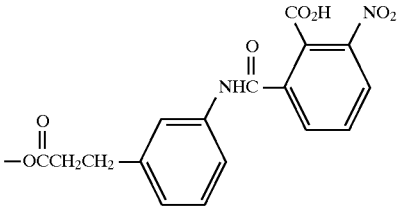 |
| 27[i] | 76 | 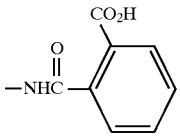 |
| 28[i] | 76 | 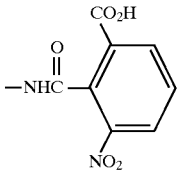 |

[i]Invention compounds used in Examples
[c]Comparison compounds

Example 1

Each layer having the composition set forth below was coated on a cellulose triacetate film support containing a subbing layer to prepare a multilayer color photographic light-sensitive material which was designated sample 101. The components utilized are shown as g/m$^2$ except for sensitizing dyes and the comparison compounds which are shown in molar amounts/mole of silver halide present in the same layer.

| Photographic Element 101 | |
|---|---|
| First Layer: Antihalation Layer | |
| Black Colloidal Silver | 0.43 (as silver) |
| Gelatin | 2.44 |
| Second Layer: Intermediate Layer | |
| Gelatin | 1.22 |
| Third Layer: Red Sensitive Layer | |
| Silver iodobromide emulsion | 0.97 (as silver) |
| RSD-1/RSD-2 | 0.00075 |
| Cyan Coupler C-1 | 1.61 |
| Dibutyl phthalate | 0.81 |
| Gelatin | 2.37 |
| Fourth Layer: Intermediate Layer | |
| Competitor CP-1 | 0.21 |
| Gelatin | 0.43 |
| Fifth Layer: Green Sensitive Layer | |
| Silver iodobromide emulsion | 1.10 (as silver) |
| Sensitizing dye GSD-1 | 0.00075 |
| Sensitizing dye GSD-2 | 0.00025 |
| Magenta coupler M-1 | 0.46 |
| Magenta coupler M-2 | 1.08 |
| Tritoyl phosphate | 0.76 |
| Gelatin | 2.37 |
| Sixth Layer: Protective Layer | |
| Gelatin | 2.37 |
| Bis(vinylsulfonylmethane) | 0.19 |

Samples 102 to 117 were prepared in the same manner as described above for Sample 101 except for the addition of the poly(alkylene oxide)s listed in Table II to the green sensitive fifth layer. The added poly(alkylene oxide)s were coated at an equivalent level of 0.6 millimole/silver mole using $\overline{Mn}$ as the molecular weight of the polymer.

Each of the samples thus prepared was cut into a 35 mm width strip. The samples were exposed to a step exposure using white light. The samples were then processed in a reversal process using standard Kodak E-6 processing solutions (note in a reversal process development acceleration occurring in the first developer will lead to enhanced speed and a suppression of Dmax). Relative speed at two different speed points and Dmax was determined for both the green and red sensitive layer. In Table III it is demonstrated that the acid capping of poly(alkylene oxide)s leads to increased speed and suppression of Dmax (effects expected for enhanced development in a reversal format), particularly for compounds 11–14. Compounds 11–14 were particularly usefully for boosting speed in the lower scale toe region (Speed 1). Table IV demonstrates the mobility of the compounds coated in Layer 5 into Layer 3. Compounds 12–13 significantly enhance development in Layer 5, particularly in the lower scale toe region, however, in Layer 3 there is a significant difference in development acceleration between Compound 12 and 13 with Compound 13 being much more layer specific. The results in Table III and IV illustrate how the activity of poly(alkylene oxide)s can be controlled through the molecular weight of the addenda and the use of acidic functional end groups leading to an active addenda that provides layer specific control of development.

TABLE III

Example 1 Green Sensitive Layer Response

| Sample | Development Accelerator | Relative Speed 1[a] | Relative Speed 2[b] | Dmax |
|---|---|---|---|---|
| 101 | None (Check) | 1.27 | 1.47 | 3.399 |
| 102 | Cmpd 1 (Comparison) | 1.27 | 1.48 | 3.336 |
| 103 | Cmpd 9 (Comparison) | 1.28 | 1.48 | 3.231 |
| 104 | Cmpd 2 (Comparison) | 1.25 | 1.46 | 3.405 |
| 105 | Cmpd 10 (Comparison) | 1.30 | 1.51 | 2.952 |
| 106 | Cmpd 3 (Comparison) | 1.26 | 1.48 | 2.988 |
| 107 | Cmpd 11 (Invention) | 1.33 | 1.56 | 2.490 |
| 108 | Cmpd 4 (Comparison) | 1.21 | 1.44 | 3.250 |
| 109 | Cmpd 12 (Invention) | 1.35 | 1.56 | 2.867 |
| 110 | Cmpd 5 (Comparison) | 1.24 | 1.46 | 3.153 |
| 111 | Cmpd 13 (Invention) | 1.37 | 1.58 | 2.933 |
| 112 | Cmpd 6 (Comparison) | 1.26 | 1.49 | 2.985 |
| 113 | Cmpd 14 (Invention) | 1.33 | 1.54 | 3.079 |
| 114 | Cmpd 7 (Comparison) | 1.26 | 1.49 | 2.977 |
| 115 | Cmpd 15 (Invention) | 1.25 | 1.46 | 3.387 |
| 116 | Cmpd 8 (Comparison) | 1.24 | 1.54 | 2.460 |
| 117 | Cmpd 16 (Invention) | 1.25 | i.s6 | 2.737 |

[a]Photographic speed in log E units at a green density of 0.5
[b]Photographic speed in log E units at a green density of 1.0

TABLE IV

Example 1 Red Sensitive Layer Response

| Sample | Development Accelerator | Relative Speed 1[a] | Relative Speed 2[b] | Dmax |
|---|---|---|---|---|
| 101 | None (Check) | 1.19 | 1.51 | 2.618 |
| 102 | Cmpd 1 (Comparison) | 1.19 | 1.51 | 2.610 |
| 103 | Cmpd 9 (Comparison) | 1.20 | 1.52 | 2.602 |
| 104 | Cmpd 2 (Comparison) | 1.19 | 1.51 | 2.626 |
| 105 | Cmpd 10 (Comparison) | 1.23 | 1.54 | 2.573 |
| 106 | Cmpd 3 (Comparison) | 1.18 | 1.51 | 2.587 |
| 107 | Cmpd 11 (Invention) | 1.28 | 1.59 | 2.463 |
| 108 | Cmpd 4 (Comparison) | 1.16 | 1.49 | 2.624 |
| 109 | Cmpd 12 (Invention) | 1.43 | 1.68 | 2.383 |
| 110 | Cmpd 5 (Comparison) | 1.16 | 1.49 | 2.601 |
| 111 | Cmpd 13 (Invention) | 1.33 | 1.60 | 2.478 |
| 112 | Cmpd 6 (Comparison) | 1.17 | 1.50 | 2.551 |
| 113 | Cmpd 14 (Invention) | 1.32 | 1.59 | 2.474 |
| 114 | Cmpd 7 (Comparison) | 1.17 | 1.50 | 2.556 |

TABLE IV-continued

| Example 1 Red Sensitive Layer Response | | | | |
|---|---|---|---|---|
| Sample | Development Accelerator | Relative Speed 1[a] | Relative Speed 2[b] | Dmax |
| 115 | Cmpd 15 (Invention) | 1.19 | 1.51 | 2.565 |
| 116 | Cmpd 8 (Comparison) | 1.16 | 1.50 | 2.476 |
| 117 | Cmpd 16 (Invention) | 1.21 | 1.54 | 2.417 |

[a]Photographic speed in log E units at a red density of 0.5
[b]Photographic speed in log E units at a red density of 1.0

Example 2

Each layer having the composition set forth below was coated on a cellulose triacetate film support provided with a subbing layer to prepare a multilayer color photographic light-sensitive material which was designated sample 201. The components utilized are shown as g/m$^2$ except for sensitizing dyes and the comparison compounds which are shown in molar amounts/mole of silver halide present in the same layer.

| Photographic Element 201 | |
|---|---|
| First Layer: Antihalation Layer | |
| Black Colloidal Silver | 0.43 (as silver) |
| Gelatin | 2.44 |
| Second Layer: Intermediate Layer | |
| Gelatin | 1.22 |
| Third Layer: Red Sensitive Layer | |
| Silver iodobromide emulsion | 0.97 (as silver) |
| RSD-1/RSD-2 | 0.00075 |
| Cyan Coupler C-1 | 1.61 |
| Dibutyl phthalate | 0.81 |
| Gelatin | 2.37 |
| Fourth Layer: Intermediate Layer | |
| Competitor CP-1 | 0.21 |
| Gelatin | 0.43 |
| Fifth Layer: Green Sensitive Layer | |
| Silver iodobromide emulsion | 1.10 (as silver) |
| Sensitizing dye GSD-1 | 0.00075 |
| Sensitizing dye GSD-2 | 0.00025 |
| Magenta coupler M-1 | 0.46 |
| Magenta coupler M-2 | 1.08 |
| Tritoyl phosphate | 0.76 |
| Gelatin | 2.37 |
| Sixth Layer: Protective Layer | |
| Gelatin | 2.37 |
| Bis(vinylsulfonylmethane) | 0.19 |

Samples 202 to 211 were prepared in the same manner as described above for Sample 201 except for the addition of the poly(alkylene oxide)s listed in Table II to the green sensitive fifth layer. The added poly(alkylene oxide)s were coated at an equivalent level of 0.4 millimole/silver mole using $\overline{Mn}$ as the molecular weight of the polymer. Compounds in this example involve structural variation using a common parent compound 5.

Each of the samples thus prepared was cut into a 35 mm width strip. The samples were exposed to a step exposure using white light. The samples were then processed using standard Kodak E-6 processing solutions. Relative speed at two different speed points and Dmax was determined for the green sensitive fifth layer.

TABLE V

| Example 2 Green Sensitive Layer Response | | | | |
|---|---|---|---|---|
| Sample | Development Accelerator | Relative Speed 1[a] | Relative Speed 2[b] | Dmax |
| 201 | None (Check) | 1.11 | 1.33 | 3.685 |
| 202 | Cmpd 5 (Comparison) | 1.13 | 1.35 | 3.424 |
| 203 | Cmpd 17 (Comparison) | 1.22 | 1.45 | 3.536 |
| 204 | Cmpd 18 (Comparison) | 1.22 | 1.43 | 3.594 |
| 205 | Cmpd 19 (Comparison) | 0.83 | 1.13 | 3.610 |
| 206 | Cmpd 25 (Comparison) | 0.82 | 1.03 | 3.695 |
| 207 | Cmpd 20 (Invention) | 1.33 | 1.54 | 3.394 |
| 208 | Cmpd 21 (Invention) | 1.32 | 1.54 | 3.350 |
| 209 | Cmpd 22 (Invention) | 1.35 | 1.57 | 3.319 |
| 210 | Cmpd 23 (Invention) | 1.32 | 1.54 | 3.350 |
| 211 | Cmpd 24 (Invention) | 1.32 | 1.54 | 3.368 |

[a]Photographic speed in log E units at a green density of 0.5
[b]Photographic speed in log E units at a green density of 1.0

From the results shown in Table V it is clear that samples using the acidic functional solublization of the present invention significantly boost speed at various points of the D LogE curve and suppress Dmax.

Example 3

Sample 301 was prepared as in Example 2. Samples 302 to 308 were prepared in the same manner as described above for Sample 301 except for the addition of the poly(alkylene oxide)s listed in Table II to the green sensitive fifth layer. The added poly(alkylene oxide)s were coated at an equivalent level of 0.6 millimole/silver mole parenthetically based on average molecular weight. A level series for compound 13 was also examined at 0.2, 0.6 and 1.2 millimole/silver mole.

Each of the samples thus prepared was cut into a 35 mm width strip. The samples were exposed to a step exposure using white light. The samples were then processed using standard Kodak E-6 processing solutions except that the time in the first developer was varied from 6 min (the standard first developer time) to 11 min first developer time. Relative speed at two different speed points and Dmax was determined for the green sensitive fifth layer.

TABLE VI

| Example 3 Green Sensitive Layer Response at 6 min First Developer Time | | | | | |
|---|---|---|---|---|---|
| Sample | Development Accelerator | Level Cmpd[a] | Relative Speed 1[b] | Relative Speed 2[c] | Dmax |
| 301 | None (Check) | | 1.17 | 1.39 | 3.674 |
| 302 | Cmpd 26 (Invention) | 0.6 | 1.25 | 1.50 | 3.122 |
| 303 | Cmpd 27 (Invention) | 0.6 | 1.29 | 1.52 | 2.928 |
| 304 | Cmpd 28 (Invention) | 0.6 | 1.30 | 1.52 | 3.060 |

TABLE VI-continued

| Example 3 Green Sensitive Layer Response at 6 min First Developer Time | | | | | |
|---|---|---|---|---|---|
| Sample | Development Accelerator | Level Cmpd[a] | Relative Speed 1[b] | Relative Speed 2[c] | Dmax |
| 305 | Cmpd 13 (Invention) | 0.2 | 1.17 | 1.39 | 3.397 |
| 306 | Cmpd 13 (Invention) | 0.6 | 1.29 | 1.52 | 3.201 |
| 307 | Cmpd 13 (Invention) | 1.2 | 1.38 | 1.60 | 2.889 |

[a]mmole compound/mole silver in the layer
[b]Photographic speed in log E units at a green density of 0.5
[c]Photographic speed in log E units at a green density of 1.0

From the results shown in Table VI it is clear that compounds 26, 27, and 28 that contain acidic functional solublization offer enhanced development, like compound 13, leading to increases in speed and Dmax suppression. It is also clear that increasing amounts of compound 13 afford greater effects.

TABLE VII

| Example 3 Green Sensitive Layer Response at 11 min First Developer Time | | | | | |
|---|---|---|---|---|---|
| Sample | Development Accelerator | Level Cmpd.[a] | Relative Speed 1[b] | Relative Speed 2[c] | Dmax |
| 301 | None (Check) | | 1.66 | 1.81 | 2.865 |
| 305 | Cmpd 13 (Invention) | 0.2 | 1.66 | 1.81 | 2.357 |
| 306 | Cmpd 13 (Invention) | 0.6 | 1.85 | 2.06 | 1.874 |
| 307 | Cmpd 13 (Invention) | 1.2 | 1.99 | 2.42 | 1.160 |

[a]mmole compound/mole silver in the layer
[b]Photographic speed in log E units at a green density of 0.5
[c]Photographic speed in log E units at a green density of 1.0

At an extended development time of 11 min (i.e. push processing) compound 13 further enhanced development leading to larger speed increases and Dmax suppression at extended development than seen at normal 6' development time. This invention can be useful for controlling photographic properties at extended development time.

Example 4

For example, in a prophetic example for a reversal format, the poly(alkylene oxide)s with acidic endgroups may be coated with approximately sensitsitized silver iodobromide emulsion in a multilayer reversal film that was prepared as follows. Each layer having the composition set forth below was coated on a cellulose triacetate support provided with a subbing layer to prepare a multilayer color photographic light-sensitive material. In the composition of the layers, the coating amounts are shown as grams per square meter except for sensitizing dyes, which are shown as the molar amount per mole of silver halide present in the same layer. Laydowns of silver halide are reported relative to silver. Emulsion sizes as determined by the disc centrifuge method are reported in diameter×thickness in microns.

First layer: Antihalation Layer
Black Colloidal Silver 0.43
Gelatin 2.44
Second layer: Intermediate Layer
Gelatin 1.22
Third layer: Slow Red Sensitive Layer
AgIBr tabular emulsion (4% I, 0.6×0.1) 0.62
RSD-1/RSD-2 0.00142
C-1 0.20
Dibutyl phthalate 0.10
ST-10.06
Gelatin 0.86
Fourth Layer: Fast Red Sensitive Layer
AgIBr tabular emulsion (4% I, 0.97×0.13) 0.65
RSD-I/RSD-2 0.00105
C-1 1.00
Dibutyl phthalate 0.50
Gelatin 1.83
Fifth Layer: Intermediate Layer
DYE-1 0.07
ST-1 0.12
Gelatin 1.22
Sixth Layer: Slow Green Sensitive Layer
AgIBr emulsion (3.3% I, 0.15 cubic+4% 1, 0.7×0.1 tabular)
0.70
GSD-1/GSD-1
0.002
M-1
0.07
M-2
0.15
Tritoyl phosphate
0.11
Gelatin
0.83
Seventh Layer: Fast Green Sensitive Layer
AgIBr tabular emulsion (4% I, 0.97×0.13)
0.50
GSD-1/GSD-2
0.001
M-1
0.32
M-2
0.74
Tritoyl phosphate
0.52
Gelatin
1.67
Eighth Layer: Interlayer Layer
Gelatin
2.15
Ninth Layer: Yellow Filter Layer
Carey Lea Silver
0.002
DYE-2
0.17
ST-1
0.08
Gelatin
0.61
Tenth Layer: Slow Blue Sensitive Layer
AgIBr tabular emulsion (3% I, 1.1×0.12)

0.28
BSD-1
0.00108
Y-1
0.66
Dibutyl phthalate
0.22
Gelatin
1.00
Eleventh Layer: Fast Blue Sensitive Layer
AgIBr tabular emulsion (3% I, 1.7×0.1)
0.78
BSD-1
0.0016
Y-1
1.68
Dibutyl phthalate
0.56
Gelatin
2.47
Twelfth Layer: First Protective Layer
UV-1
0.06
UV-2
0.32
UV-3
0.09
ST-1
0.06
Gelatin
1.40
Thirteenth Layer: Second Protective Layer
Fine grain AgBr emulsion
0.12
Matte
0.02
Bis(vinylsulfonylmethane)
0.26
Gelatin
0.97
Structures used in Example 1–4
BSD-1
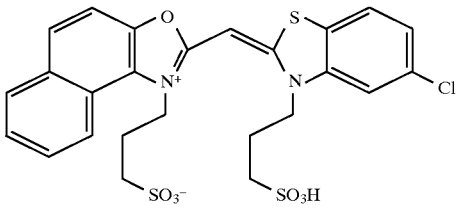
GSD-1
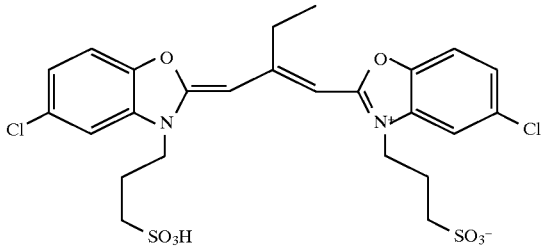
GSD-2
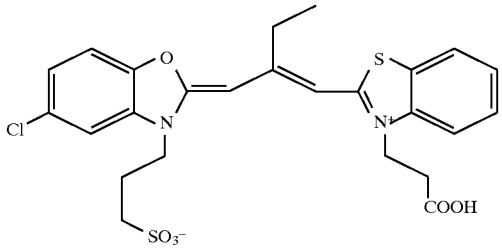
RSD-1
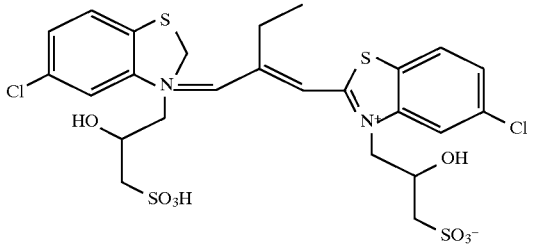

-continued
RSD-2
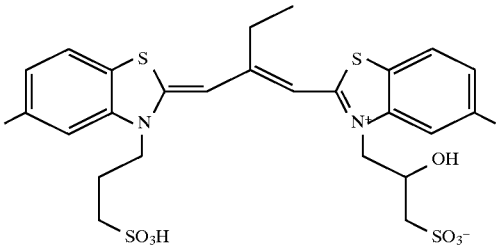
UV-1
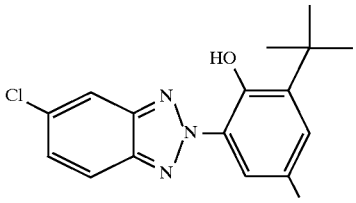
UV-2
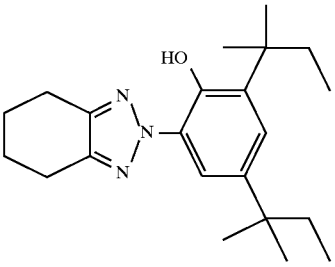
UV-3
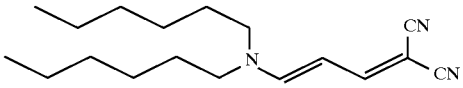
DYE-1
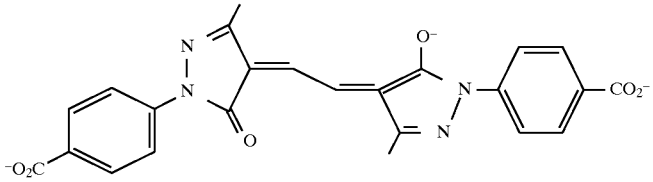
DYE-2
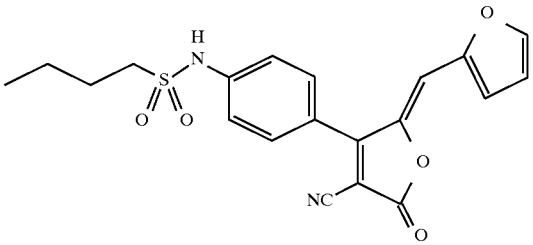
Y-1
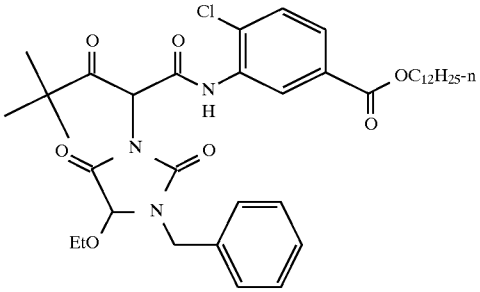

-continued

M-1

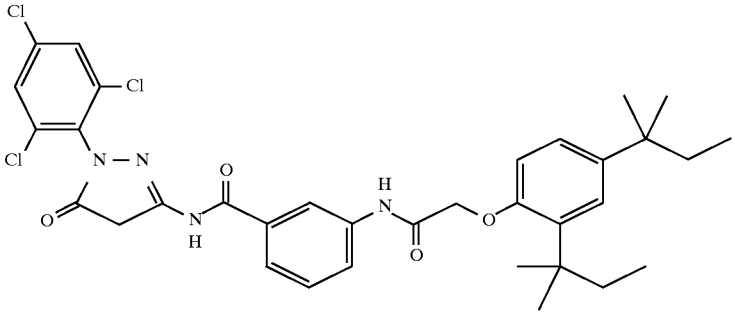

M-2

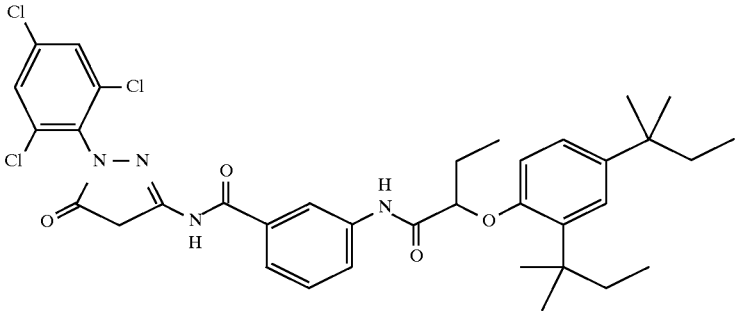

C-1

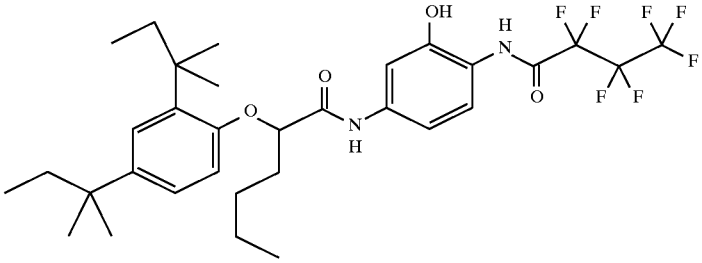

ST-1

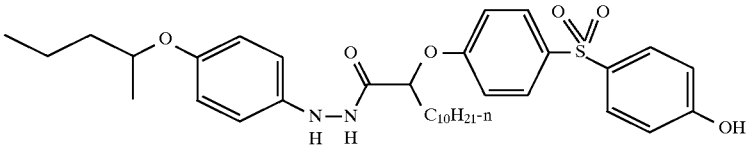

CP-1:

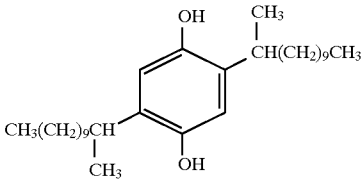

Example 5

In a prophetic example for a reversal format, the poly (alkylene oxide)s with acidic functional endgroups may be coated with appropriately sensitized silver iodobromide emulsions on a support bearing the following layers from top to bottom:

(1) one or more overcoat layers;

(2) a nonsensitized silver halide containing layer;

(3) a triple-coat yellow layer pack with a fast yellow layer containing "Coupler 1": Benzoic acid, 4-(1-(((2-chloro-5-((dodecylsulfonyl)amino)phenyl)amino) carbonyl)-3,3-dimethyl-2 -oxobutoxy)-, 1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast and mid magenta layer containing "Coupler 3": 2-Propenoic acid, butyl ester, polymer with N-[1-(2,5-dichlorophenyl)-4,5-dihydro-5-oxo-1H-pyrazol-3-yl]-2-methyl-2-propenamide; "Coupler 4": Benzamide, 3-(2-(2,4-bis(1,1-dimethylpropyl)phenoxy)-1-oxobutyl) amino)-N-(4,5-dihydro-5-oxo-1-(2,4,6-trichlorophenyl)-1H-pyrazol-3-yl)-; and "Coupler 5": Benzamide, 3-(((2,4-bis(1,1-dimethylpropyl)phenoxy) -acetyl)amino)-N-(4,5-dihydro-5-oxo-1-(2,4,6-trichlorophenyl)-1H-pyrazol-3-yl)-; and containing the stabilizer 1,1'-Spirobi(1H-indene), 2,2',3,3'-tetrahydro-3,3,3',3'-tetramethyl-5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-(4-((2,2,3,3,4,4,4-heptafluoro-1-oxobutyl)amino)-3-hydroxyphenyl)-; a mid cyan containing "Coupler 7": Butanamide, N-(4-((2-(2,4-bis(1,1-dimethylpropyl)phenoxy)-1-oxobutyl)amino)-2-hydroxyphenyl)-2,2,3,3,4,4,4-heptafluoro- and "Coupler 8": Hexanamide, 2-(2,4-bis(1,1-dimethylpropyl)-phenoxy)-N-(4-((2,2,3,3,4,4,4-heptafluoro-1-oxobutyl)amino)-3-hydroxyphenyl)-; and a slow cyan layer containing Couplers 6, 7, and 8;

(10) one or more interlayers possibly including fine-grained nonsensitized silver halide; and

(11) an antihalation layer.

Example 6

For example, in a prophetic example in a negative format, the poly(alkylene oxide)s with acidic functional endgroups may be coated with appropriatedly sensitsitized silver iodobromide emulsion in a multilayer photographic negative element that was produced by coating the following layers on a cellulose triacetate film support (coverage are in grams per meter squared, emulsion sizes as determined by the disc centrifuge method and are reported in Diameter×Thickness in microns).

Layer 1 (Antihalation layer): black colloidal silver sol at 0.151; gelatin at 2.44; UV-1 at 0.075; UV-2 at 0.075; DYE-3 at 0.042; DYE-4 at 0.088; DYE-5 at 0.020; DYE-6 at 0.008 and STAB-1 at 0.161.

Layer 2 (Slow cyan layer): a blend of two silver iodobromide emulsions sensitized with a ⅙ mixture of RSD-3/RSD-4: (i) a small tabular emulsion (1.1×0.09, 4.1 mol % I) at 0.430 and (ii) a very small tabular grain emulsion (0.5×0.08, 1.3 mol % I) at 0.492; gelatin at 1.78; cyan dye-forming coupler C-2 at 0.538; bleach accelerator releasing coupler BARC-1 at 0.038; masking coupler MC-1 at 0.027.

Layer 3 (Mid cyan layer): a red sensitized (same as above) silver iodobromide emulsion (1.3×0.12, 4.1 mol % I) at 0.699; gelatin at 1.79; C-2 at 0.204; D-1 at 0.010; MC-1 at 0.022.

Layer 4 (Fast cyan layer): a red-sensitized (same as above) tabular silver iodobromide emulsion (2.9×0.13, 4.1 mol % I) at 1.076; C-2 at 0.072; D-1 at 0.019; D-2 at 0.048; MC-1 at 0.032; gelatin at 1.42.

Layer 5 (Interlayer): gelatin at 1.29.

Layer 6 (Slow magenta layer): a blend of two silver iodobromide emulsions sensitized with a 6/1 mixture of GSD-3/GSD-4: (i) 1.0×0.09, 4.1 mol % iodide at 0.308 and (ii) 0.5×0.08, 1.3% mol % I at 0.584; magenta dye forming coupler M-3 at 0.269; masking coupler MC-2 at 0.064; stabilizer STAB-2 at 0.054; gelatin at 1.72.

Layer 7 (Mid magenta layer): a green sensitized (as above) silver iodobromide emulsion: 1.3×0.12, 4.1 mol % iodide at 0.968; M-3 at 0.071; MC-2 at 0.064; D-3 at 0.024; stabilizer STAB-2 at 0.014; gelatin at 1.37.

Layer 8 (Fast magenta layer): a green sensitized (as above) tabular silver iodobromide (2.3×0.13, 4.1 mol % I) emulsion at 0.968; gelatin at 1.275; Coupler M-3 at 0.060; MC-2 at 0.054; D-4 at 0.0011; D-5 at 0.0011 and stabilizer STAB-2 at 0.012.

Layer 9 (Yellow filter layer): AD-1 at 0.108 and gelatin at 1.29.

Layer 10 (Slow yellow layer): a blend of three tabular silver iodobromide emulsions sensitized with sensitizing dye BSD-2: (i) 0.5×0.08, 1.3 mol% I at 0.295 (ii) 1.0×0.25, 6 mol % I at 0.50 and (iii) 0.81×0.087, 4.5 mol % I at 0.215; gelatin at 2.51; yellow dye forming couplers Y-1 at 0.725 and Y-2 at 0.289; D-6 at 0.064; C-1 at 0.027 and BARC-1 at 0.003.

Layer 11 (Fast yellow layer): a blend of two blue sensitized (as above) silver iodobromide emulsions: (i) a large tabular emulsion, 3.3×0.14, 4.1 mol % I at 0.227 and (ii) a 3-D emulsion, 1.1×0.4, 9 mol % I at 0.656; Y-1 at 0.725; Y-2 at 0.289; D-6 at 0.029; C-1 at 0.048; BARC-1 at 0.007 and gelatin at 2.57.

Layer 12 (UV filter layer): gelatin at 0.699; silver bromide Lippman emulsion at 0.215; UV-1 at 0.011 and UV-2 at 0.011.

Layer 13 (Protective overcoat): gelatin at 0.882.

Hardener (bis(vinylsulfonyl)methane hardener at 1.75% of total gelatin weight), antifoggants (including 4-hydroxy-6-methyl-1,3,3a,7-tetraazaindene), surfactants, coating aids, emulsion addenda, sequestrants, lubricants, matte and tinting dyes were added to the appropriate layers as is common in the art.

Structures Example 6

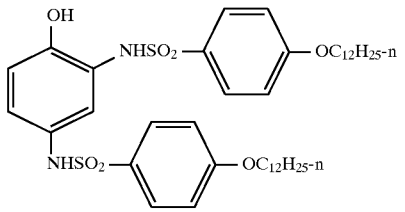

STAB-1

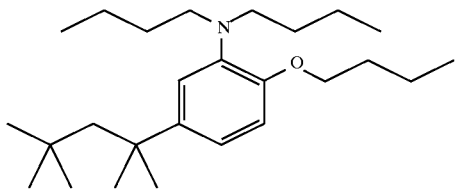

STAB-2

-continued
DYE-3
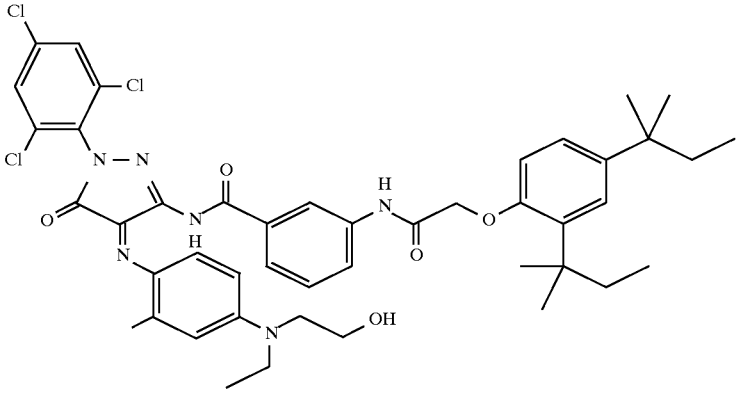
DYE-4
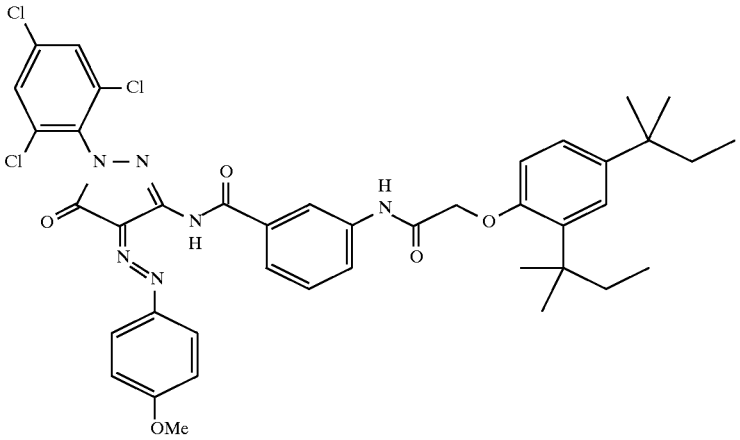
DYE-5
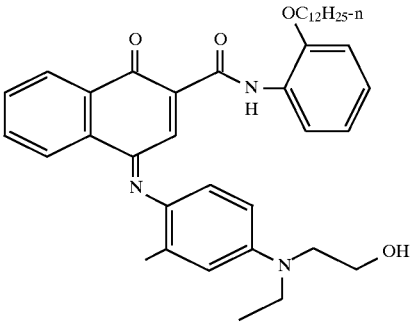
DYE-6
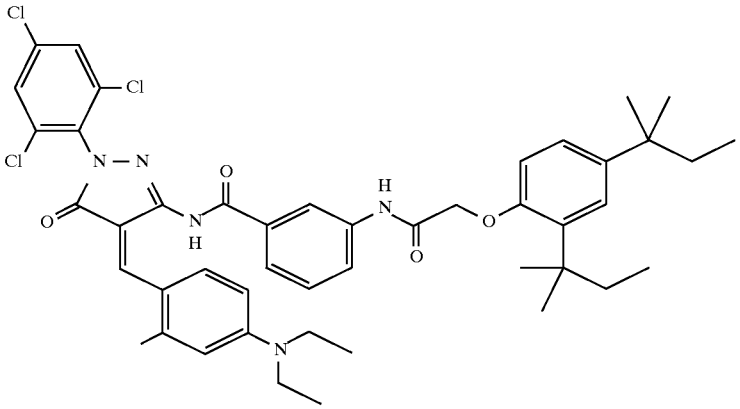

-continued
D-1
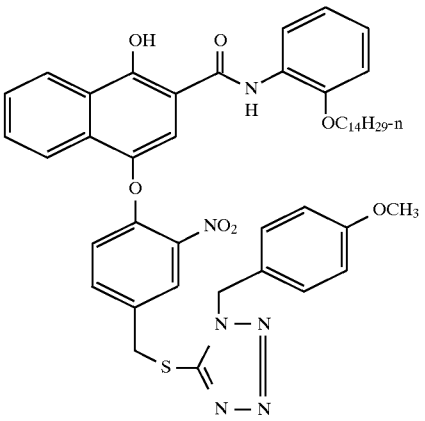
D-2
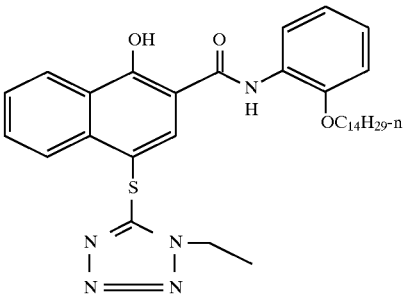
D-3
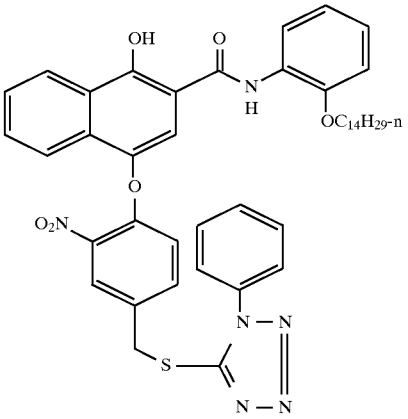
D-4
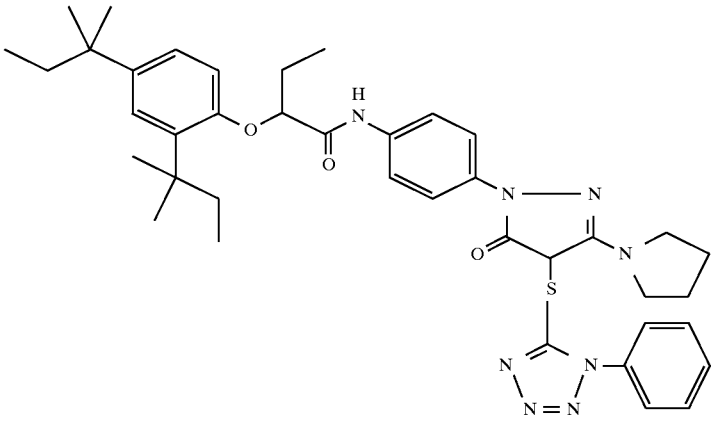

-continued
D-5
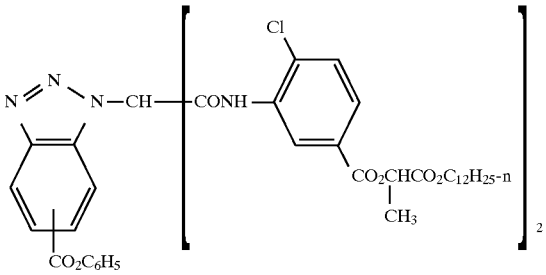
D-6
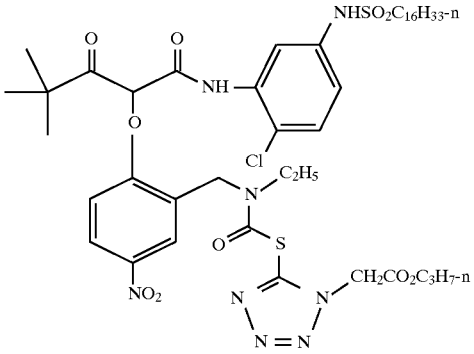
C-2
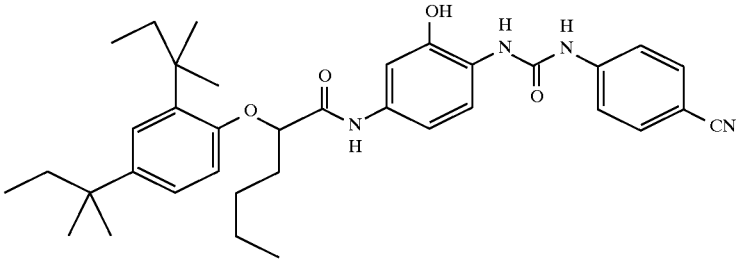
M-3
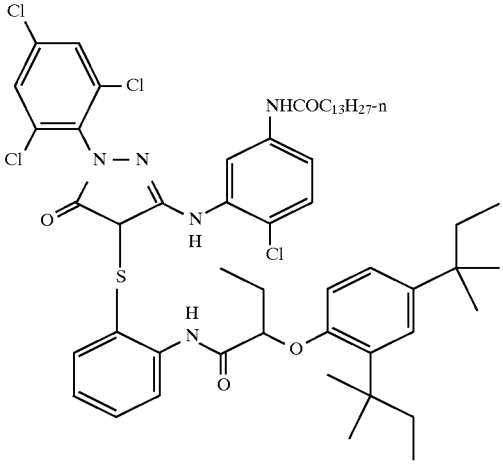

-continued
Y-1
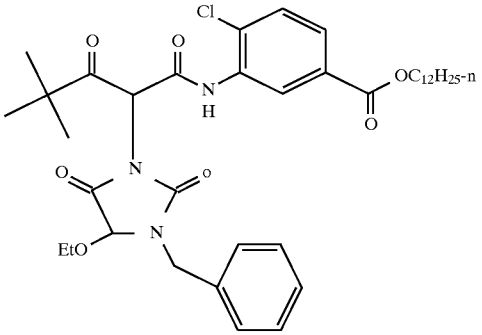
Y-2
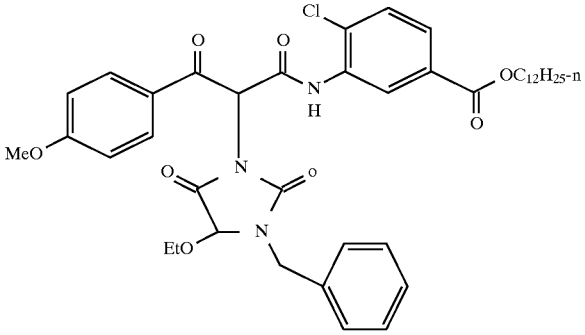
BARC-1
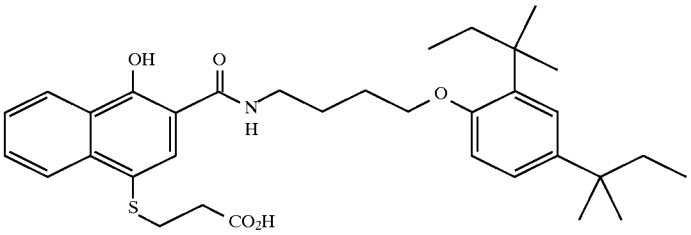
MC-1
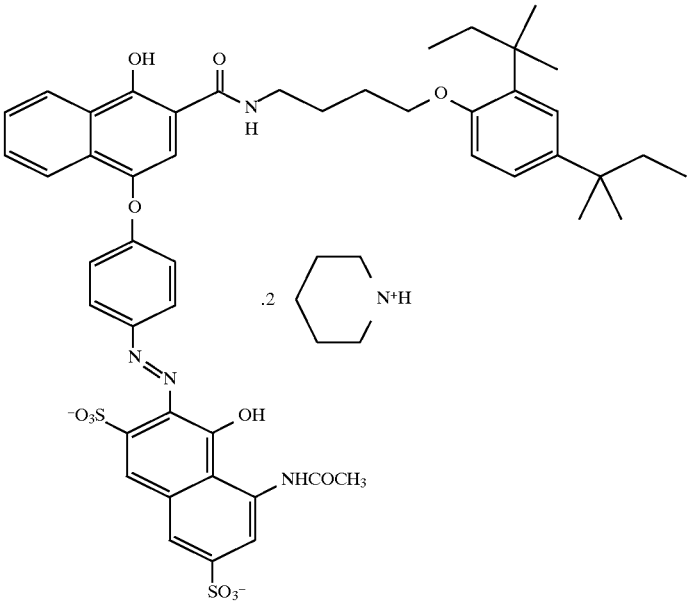

-continued
MC-2
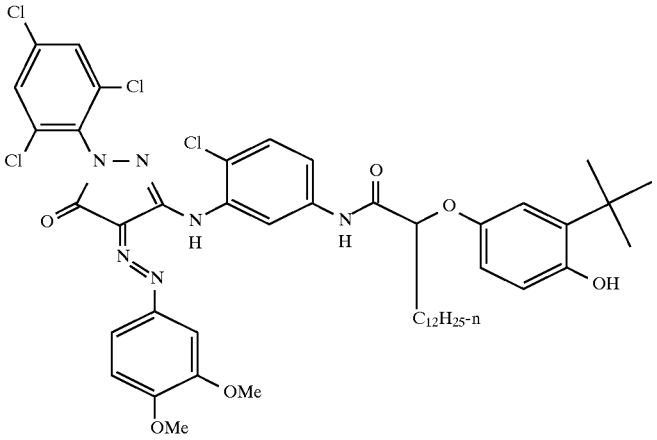
AD-1
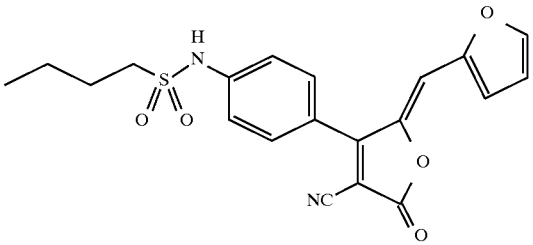
UV-3
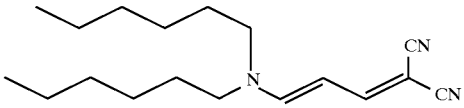
UV-4
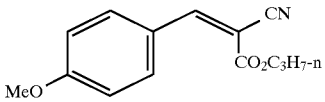
RSD-3
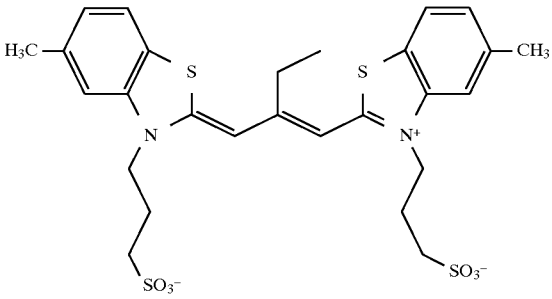
RSD-4
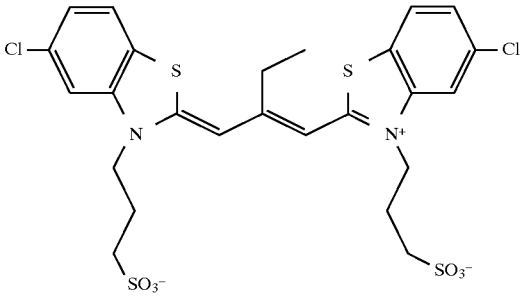

-continued

GSD-3

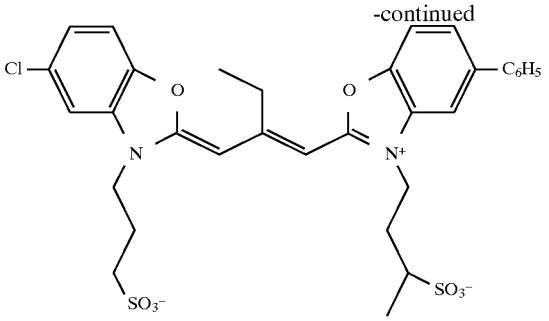

GSD-4

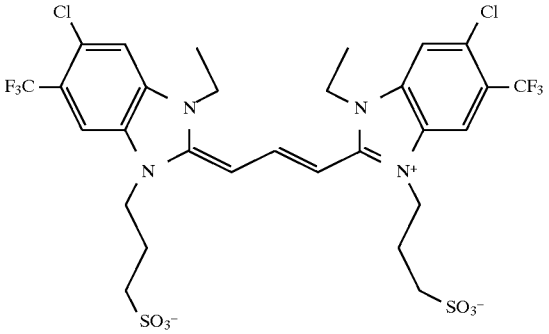

BSD-2

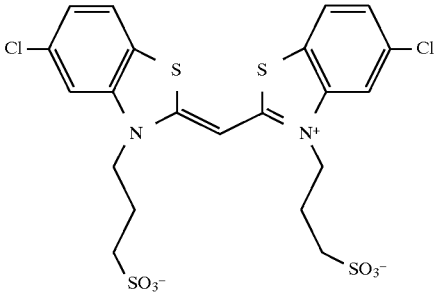

Example 7

For example, in a prophetic example in a color negative element, the poly(alkylene oxide)s with acidic functional end groups may be coated with appropriately sensitized silver iodobromide emulsions on a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3-(phenylmethyl)-1-imidazolidinyl)-3-(4-methoxyphenyl)-1,3-dioxopropyl)amino)-, dodecyl ester and a slow yellow layer containing the same compound together with "Coupler 2": Propanoic acid, 2-[[5-[[4-[2-[[[2,4-bis(1,1-dimethylpropyl)phenoxy]-acetyl]amino]-5-[(2,2,3,3,4,4,4-heptafluoro-1-oxobutyl)amino]-4-hydroxyphenoxy]-2,3-dihydroxy-6-[(propylamino)carbonyl]phenyl]-thio]-1,3,4-thiadiazol-2-yl]thio]-, methyl ester and "Coupler 3": 1-((dodecyloxy)carbonyl)ethyl(3-chloro-4-((3-(2-chloro-4-((1-tridecanoylethoxy)carbonyl)anilino)-3-oxo-2-((4)(5)(6)-(phenoxycarbonyl)-1H-benzotriazol-1-yl)propanoyl)amino))-benzoaite;

(3) an interlayer containing fine metallic silver;

(4) a triple-coat magenta pack with a fast magenta layer containing "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-, "Coupler 5": Benzamide, 3-((2-(2,4-bis(1,1-dimethylpropyl)phenoxy)-1-oxobutyl)amino)-N-(4',5'-dihydro-5'-oxo-1'-(2,4,6-trichlorophenyl) (1,4'-bi-1H-pyrazol)-3'-yl)-, "Coupler 6": Carbamic acid, (6-(((3-(dodecyloxy)propyl)amino)carbonyl)-5-hydroxy-1-naphthalenyl)-, 2-methylpropyl ester, "Coupler 7": Acetic acid, ((2-((3-(((3-(dodecyloxy)propyl)amino) carbonyl)-4-hydroxy-8-(((2-methyl-propoxy)carbonyl)amino)-1-naphthalenyl)oxy)ethyl)thio)-, and "Coupler 8": Benzamide, 3-((2-(2,4-bis(1,1-dimethylpropyl)-phenoxy)-1-oxobutyl)amino)-N-(4,5-dihydro-4-((4-methoxyphenyl)-azo)-5-oxo-1-(2,4,6-trichlorophenyl)-1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)-4,5-dihydro-5-oxo-1H-pyrazol-3-yl]-2-methyl-2-propenamide; and "Coupler 10": Tetradecanamide, N-(4-chloro-3-((4-((4-((2,2-dimethyl-1-oxopropyl)amino)phenyl)azo)-4,5-dihydro-5-oxo-1-(2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)-phenoxy)propyl)amino)-carbonyl)-4-hydroxy-1-naphthalenyl)oxy)ethoxy)phenyl)azo)-4-hydroxy-, disodium salt; and a slow cyan layer containing Couplers 2 and 6;

(7) an undercoat layer containing Coupler 8; and (8) an antihalation layer.

The invention has been described in detail with particular reference to certain preferred embodiments thereof, but it will be understood that variations and modifications can be effected within the spirit and scope of the invention.

What is claimed is:

1. A silver halide color multilayer photographic element comprising a support, at least two silver halide emulsion layers and poly(alkylene oxide)s wherein greater than 50 percent of the poly(alkylene oxide)s have acidic functional end groups with an aqueous pKa≦10, or end groups which will react to form acidic functional end groups with an aqueous pKa≦10 during development, on both termini; and wherein the poly(alkylene oxide)s have a molecular weight ranging substantially between 3000 and 6000 AMU.

2. The silver halide color photographic element of claim 1 wherein greater than 95 percent of the poly(alkylene oxide)s have acidic functional end groups with an aqueous pKa≦10, or end groups which will react to form acidic functional end groups with an aqueous pKa≦10 during development, on both termini.

3. The silver halide color photographic element of claim 1 wherein the poly(alkylene oxide)s have a molecular weight ranging substantially between 3000 and 4500 AMU.

4. A silver halide color multilayer photographic element comprising a support, at least two silver halide emulsion layers and poly(alkylene oxide)s wherein greater than 50 percent of the poly(alkylene oxide)s are represented by Formula I $$A-(L_i-X_i)_n-L-A' \qquad \text{I}$$

wherein

A and A' are independently acidic functional groups;

L and $L_i$ are independently divalent organic linking groups;

$X_i$ is independently a non-metallic heteroatom; with the proviso that at least one $X_i$ is an oxygen; and n is one to 300; and wherein the poly(alkylene oxide)s have a molecular weight ranging substantially between 3000 and 6000 AMU.

5. The silver halide photographic element of claim 4 wherein greater than 95 percent of the of poly(alkylene oxide)s are represented by Formula I.

6. The silver halide photographic element of claim 4 wherein the poly(alkylene oxide)s have a molecular weight ranging substantially between 3000 and 4500 AMU.

7. The silver halide photographic element of claim 4 wherein A and A' are independently carboxylic acid, carboxylate salt, or sulfonic acid.

8. The silver halide photographic element of claim 4 wherein L and $L_i$ are independently substituted or unsubstituted alkylene, alkenyl, arylene, aralkylene or heteroarylene groups.

9. The silver halide photographic element of claim 8 wherein L and $L_i$ are substituted or unsubstituted ethylene groups.

10. The silver halide photographic element of claim 4 wherein $X_i$ is independently —O—, —SO—, —$SO_2$—, or —$NR_1$— wherein $R_1$ is hydrogen or a carboxyl, sulfonyl, or substituted or unsubstituted unsubstituted alkyl, alkenyl, aryl, aralkyl or heteroaryl group.

11. The silver halide photographic element of claim 10 wherein $X_i$ is —O—.

12. The silver halide photographic element of claim 4 wherein the L and $L_i$ are independently substituted or unsubstituted aklylene, arylene, or arylakylene groups; A and A' are independently carboxylic acid, a carboxylate salt, or sulfonic acid; and $X_i$ is independently —O—, —SO—, —$SO_2$—, or —$NR_1$— wherein $R_1$, is hydrogen or a carboxyl, sulfonyl, or substituted or unsubstituted unsubstituted alkyl, alkenyl, aryl, aralkyl or heteroaryl groups.

13. The silver halide photographic element of claim 12 wherein L and $L_i$ are substituted or unsubstituted ethylene groups.

14. The silver halide photographic element of claim 12 wherein $X_i$ is —O—.

* * * * *